US011136827B2

(12) United States Patent
Caron et al.

(10) Patent No.: US 11,136,827 B2
(45) Date of Patent: Oct. 5, 2021

(54) ELECTRICALLY-POWERED DRILLING RIG AND METHOD FOR OPERATING THEREOF

(71) Applicant: CARON TECHNOLOGIES INTERNATIONAL INC., Québec (CA)

(72) Inventors: Jean-Claude Caron, Québec (CA); Mario Levesque, Québec (CA)

(73) Assignee: CARON TECHNOLOGIES INTERNATIONAL INC., Brossard (CA)

( * ) Notice: Subject to any disclaimer, the term of this patent is extended or adjusted under 35 U.S.C. 154(b) by 0 days.

(21) Appl. No.: 16/759,269

(22) PCT Filed: Oct. 25, 2018

(86) PCT No.: PCT/CA2018/051352

§ 371 (c)(1),
(2) Date: Apr. 24, 2020

(87) PCT Pub. No.: WO2019/079899

PCT Pub. Date: May 2, 2019

(65) Prior Publication Data

US 2021/0172252 A1 Jun. 10, 2021

Related U.S. Application Data

(60) Provisional application No. 62/576,833, filed on Oct. 25, 2017.

(51) Int. Cl.

| | |
|---|---|
| ***E21B 41/00*** | (2006.01) |
| ***E21B 4/04*** | (2006.01) |
| ***E21B 21/01*** | (2006.01) |

(52) U.S. Cl.

CPC ..... *E21B 4/04* (2013.01); *E21B 21/01* (2013.01); *E21B 41/0021* (2013.01); *E21B 41/0085* (2013.01)

(58) Field of Classification Search

CPC ..... E21B 7/026; E21B 7/02; E21B 41/0085

See application file for complete search history.

(56) References Cited

U.S. PATENT DOCUMENTS 4,057,116 A 11/1977 Striegler
4,759,414 A 7/1988 Willis
(Continued)

FOREIGN PATENT DOCUMENTS

CA 2556563 C 8/2005

OTHER PUBLICATIONS

International Preliminary Report on Patentability (Chapter II), PCT/CA2018/051352, dated Jan. 20, 2020, Canadian Intellectual Property Office, Gatineau (Quebec), Canada, 28 pages.

(Continued)

*Primary Examiner* — Kristyn A Hall
(74) *Attorney, Agent, or Firm* — Dergosits & Noah LLP

(57) ABSTRACT

An electrically powered drilling rig, such as for slim hole drilling, includes a drilling floor positioned over a drilling well, a set of pieces of drilling equipment operable for drilling the well, a first enclosure being positioned remotely of the drilling well and at least one electric motor being housed within the first enclosure. The electric motor is operated to provide power to one or more of the set of pieces of drilling equipment. The electric motor is housed within the enclosure and is remote of the drilling well and provides a buffer therebetween to prevent sparks from reaching the drilling well, thereby decreasing a fire hazard. The electric motor may be powered by a mobile battery pack. The electric motor may power a hydraulic pump, which further provides hydraulic fluid under pressure to the pieces of drilling equipment.

32 Claims, 12 Drawing Sheets

(56) References Cited

U.S. PATENT DOCUMENTS

| | | | | |
|---|---|---|---|---|
| 4,813,493 | A | 3/1989 | Shaw et al. | |
| 4,899,832 | A | 2/1990 | Bierscheid, Jr. | |
| 6,745,852 | B2 | 5/2004 | Kadaster et al. | |
| 8,955,636 | B2 | 2/2015 | Kuittinen et al. | |
| B914,007 | I5 | 9/2015 | Schwefe et al. | |
| 9,140,110 | B2 | 9/2015 | Coli et al. | |
| 9,334,667 | B2 | 5/2016 | Wijning et al. | |
| 9,546,543 | B2 | 1/2017 | Mansperger | |
| 10,018,021 | B2 | 7/2018 | Romer et al. | |
| 2014/0096974 | A1* | 4/2014 | Coli | B01F 7/00008 166/358 |
| 2015/0135607 | A1 | 5/2015 | Ferrari | |
| 2016/0369609 | A1 | 12/2016 | Morris et al. | |

OTHER PUBLICATIONS

Written Opinion of the International Searching Authority, PCT/CA2018/051352, dated Jan. 11, 2019, Canadian Intellectual Property Office, Gatineau (Quebec), Canada, 4 pages.

* cited by examiner

ELECTRICALLY-POWERED DRILLING RIG AND METHOD FOR OPERATING THEREOF

RELATED PATENT APPLICATION

The present application claims priority from U.S. provisional patent application No. 62/576,833, filed Oct. 25, 2017 and entitled "ELECTRICALLY-POWERED DRILLING RIG AND METHOD FOR OPERATING THEREOF", the disclosure of which is hereby incorporated by reference in its entirety.

TECHNICAL FIELD

The present disclosure generally relates to an electrically-powered drilling rig and a method for operating the drilling rig. More particularly, the drilling rig includes at least one electric motor that powers one or more drilling equipment systems of the drilling rig.

BACKGROUND

A typical drilling rig, such as those used for drilling stratigraphic pits of the slim hole type, use a fossil fuel motor that is coupled to a high flow-rate hydraulic pump, which further feeds winches, hydraulic cylinders and drill bits of the drilling rig. In a slim hole operation, the fossil fuel motor may be a diesel motor rated at approximately 250 HP (186 kW). In the case of a slim hole drilling operation, the footprint of the typical drilling rig may be about 12000 $m^2$.

U.S. Pat. No. 4,899,832 provides a highly automated well drilling apparatus that is transportable in modular units to a well site where the units are rapidly assembled into an integrated operational assembly. The apparatus includes a drilling unit and two raising units that are locked to the respective opposite sides thereof. After base structures on the raising units are lowered to the ground to provide a support, the towers of the raising units and the mast of the drilling unit are simultaneously elevated to the vertical. The same raising units then are employed to erect pipe supply frames that are connected to the front of each tower. The drilling unit includes a top rotary drive, an automated power tong, and a pipe handling system that are remotely operated from a control center. Power supply, mud return, mud supply and mud pump units also are located in a unique array adjacent the drilling unit to provide an integrated and efficient drilling system.

U.S. Pat. No. 8,955,636 provides a rock drilling rig and a method for transmission thereof for the field of rock drilling. The rock drilling rig includes a carriage that is movable by drive equipment in a mine. The rock drilling rig includes a hydraulic drilling system for which pressure energy is generated by a hydraulic pump. The rock drilling rig is electrically driven and includes an electric motor that is connected to drive both the drive equipment and the hydraulic drilling system. The mechanical drive transmission included in the drive equipment and the hydraulic pump of the hydraulic drilling system may be connected and disconnected independently of one another by means of clutches.

U.S. Pat. No. 9,546,543 provides a remote controlled drilling rig that is fully functional that includes a drilling rig, an electrical assembly, and a remote. The drilling rig includes a truck for towing a semi-trailer on which is positioned a derrick and a drilling assembly. The electrical assembly is positioned within the drilling rig and includes a battery for powering components of the drilling rig, in addition to a receiver and circuit board for receiving and processing command signals respectively. The receiver is communicably coupled to a transmitter housed within a casing of the remote. A plurality of controls is used to send input commands to the transmitter, which are in turn transmitted to the receiver in order to control functions of the drilling rig, such as raising and lowering the derrick. A draw-works assembly allows for raising and lowering a traveling block within the derrick by winding and unwinding a drilling cable connected between.

U.S. Pat. No. 4,057,166 provides a slim hole drilling method wherein a wellbore of a diameter no greater than about 6 inches is drilled using a drill pipe rotation rate of at least 500 rpm and rotating the drill pipe with at least one electric motor operably connected to the drill pipe. Drilling power units for carrying out the drilling method which employ at least one electric motor in mechanical connection with the drill pipe for rotating the drill pipe and moving with same as it advances toward and away from the wellbore.

SUMMARY

According to one aspect, there is provided an electrically powered drilling rig having a drilling floor positioned over a drilling well, a set of pieces of drilling equipment operable for drilling the well, a first enclosure being positioned remotely of the drilling well, and at least one electric motor being housed within the first enclosure, the electric motor providing power to one or more of the set of pieces of drilling equipment.

According to another aspect, there is provided an electrically powered drilling rig having a drilling floor positioned over a drilling well, a set of pieces of drilling equipment operable for drilling the well, and at least one electric motor being housed within a first enclosure, the electric motor providing power to one or more of the set of pieces of drilling equipment, and the first enclosure providing a buffer between the at least one electric motor and the drilling well, whereby the first enclosure prevents sparks from electric motor from reaching the drilling well.

According to yet another aspect, there is provided an electrically powered drilling rig having a drilling floor positioned over a drilling well, a set of pieces of drilling equipment operable for drilling the well, the set including a drill drive, at least one electric motor, and a hydraulic pump powered by the electric motor, the hydraulic pump being configured to provide hydraulic energy to the set of pieces of drilling equipment.

According to yet another aspect, there is provided a method for operating an electrically powered drilling rig. The method includes positioning a drilling floor over a drilling well, providing power from at least one electric motor to a set of pieces of drilling equipment operable from drilling the well, the at least one electric motor being housed within a first enclosure positioned remotely of the drilling well, and operating a set of pieces of drilling equipment to drill the well.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
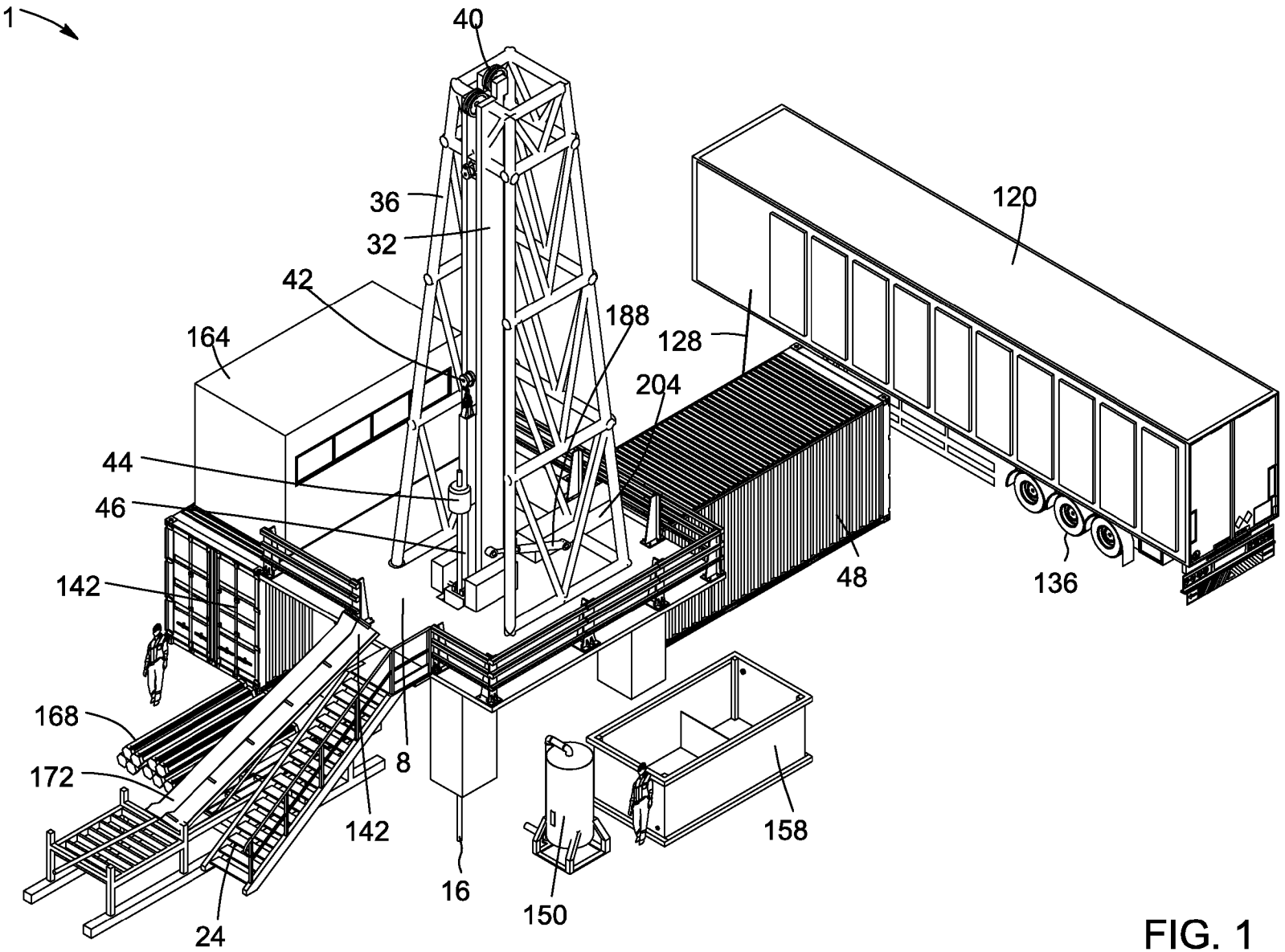
FIG. 1 illustrates a perspective view from a first direction of an electrically-powered drilling rig according to an example embodiment.
Figure 2:
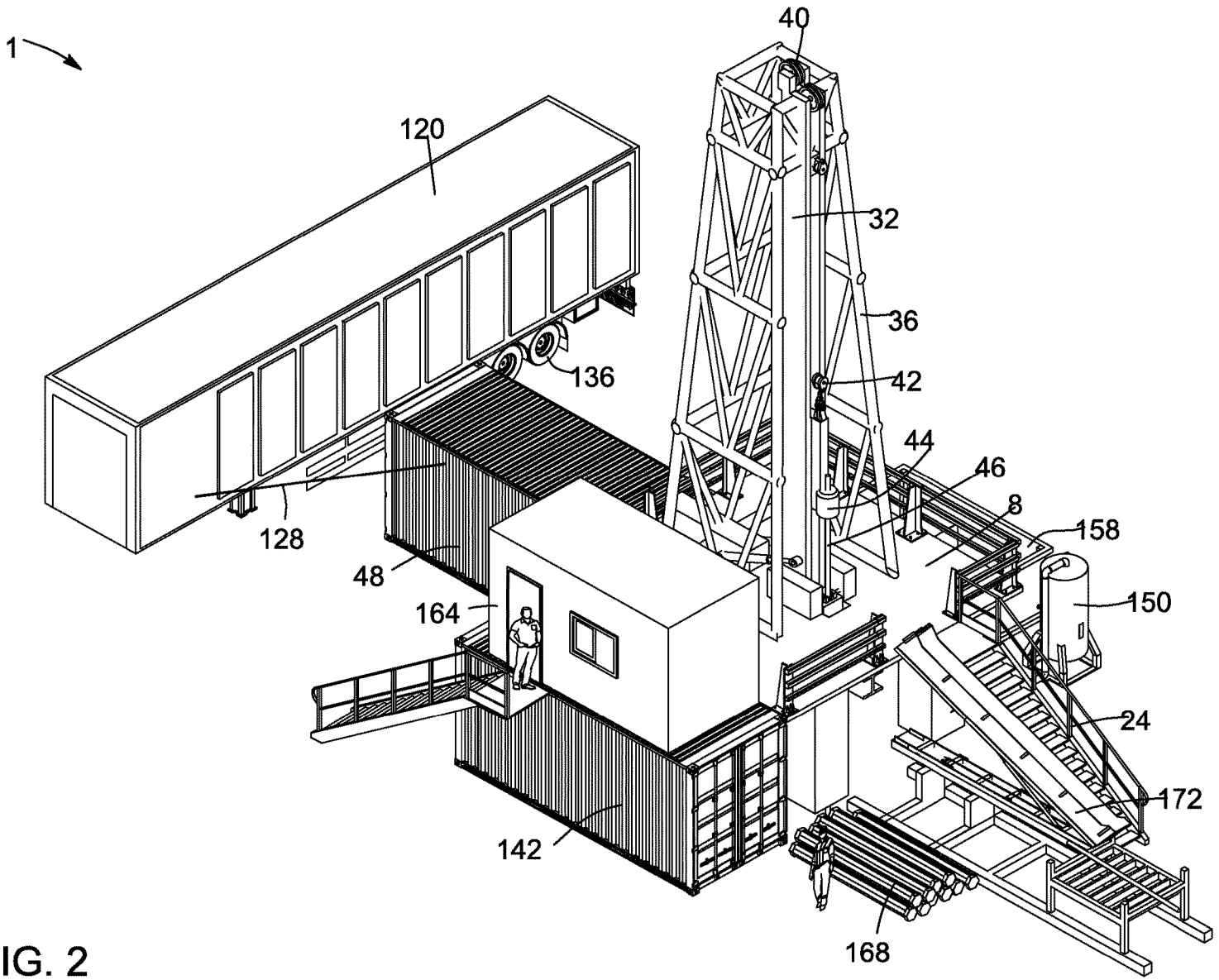
FIG. 2 illustrates a perspective view from a second direction of the electrically-powered drilling rig according to the example embodiment.
Figure 3:
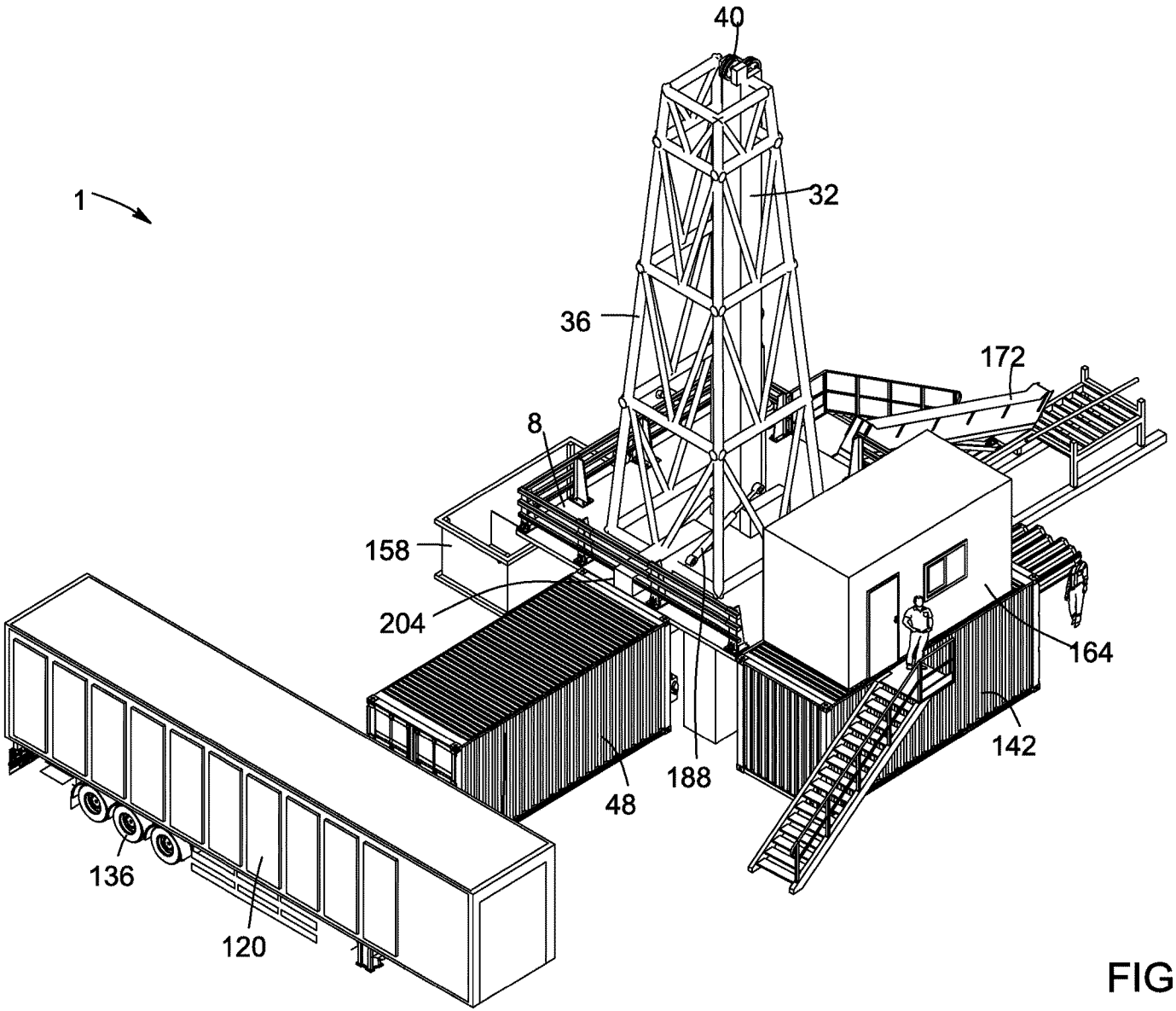
FIG. 3 illustrates a perspective view from a third direction of the electrically-powered drilling rig according to the example embodiment.
Figure 4:
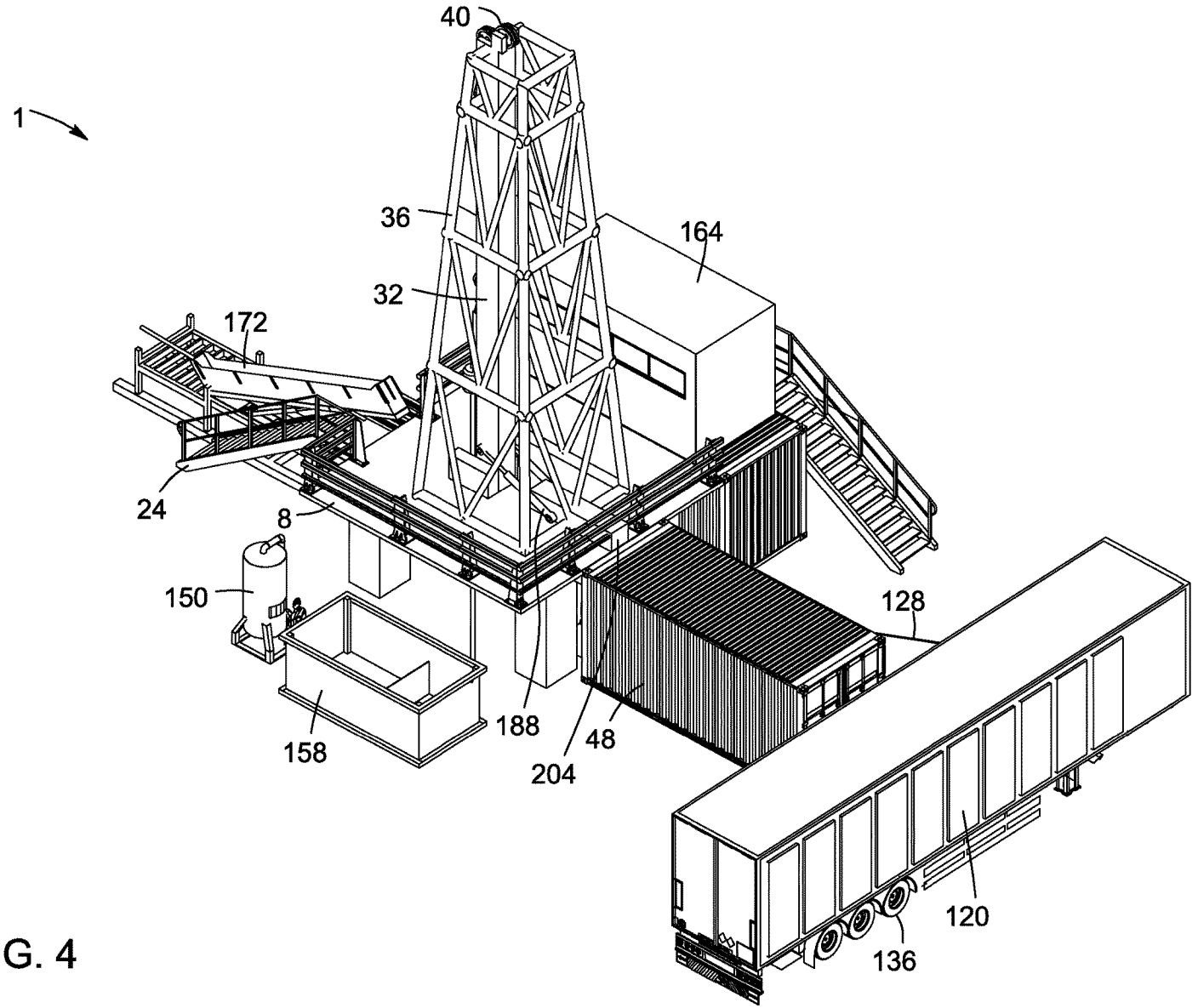
FIG. 4 illustrates a perspective view from a fourth direction of the electrically-powered drilling rig according to the example embodiment.
Figure 5:
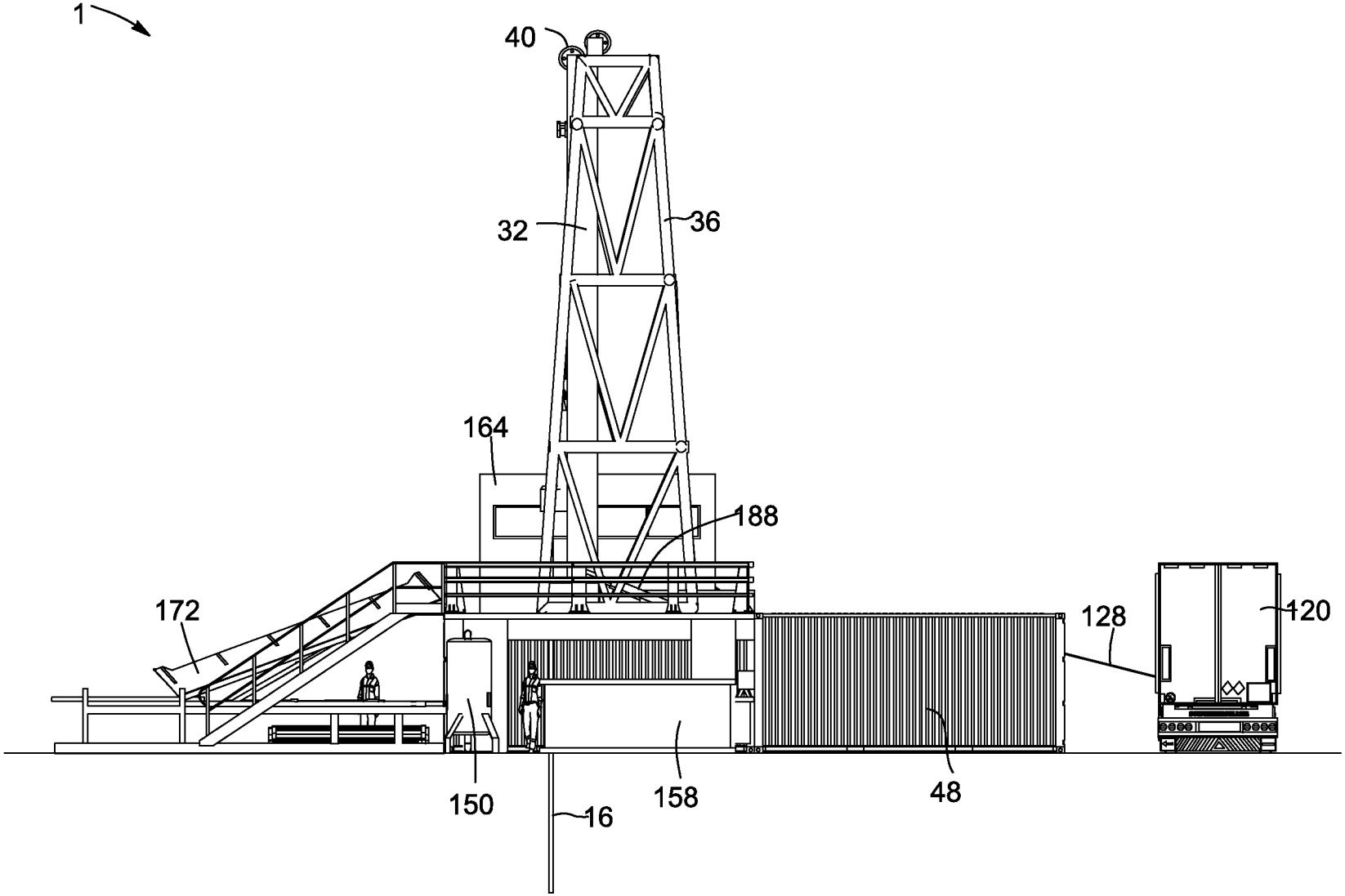
FIG. 5 illustrates an elevation view from a first side of the electrically-powered drilling rig according to the example embodiment.
Figure 6:
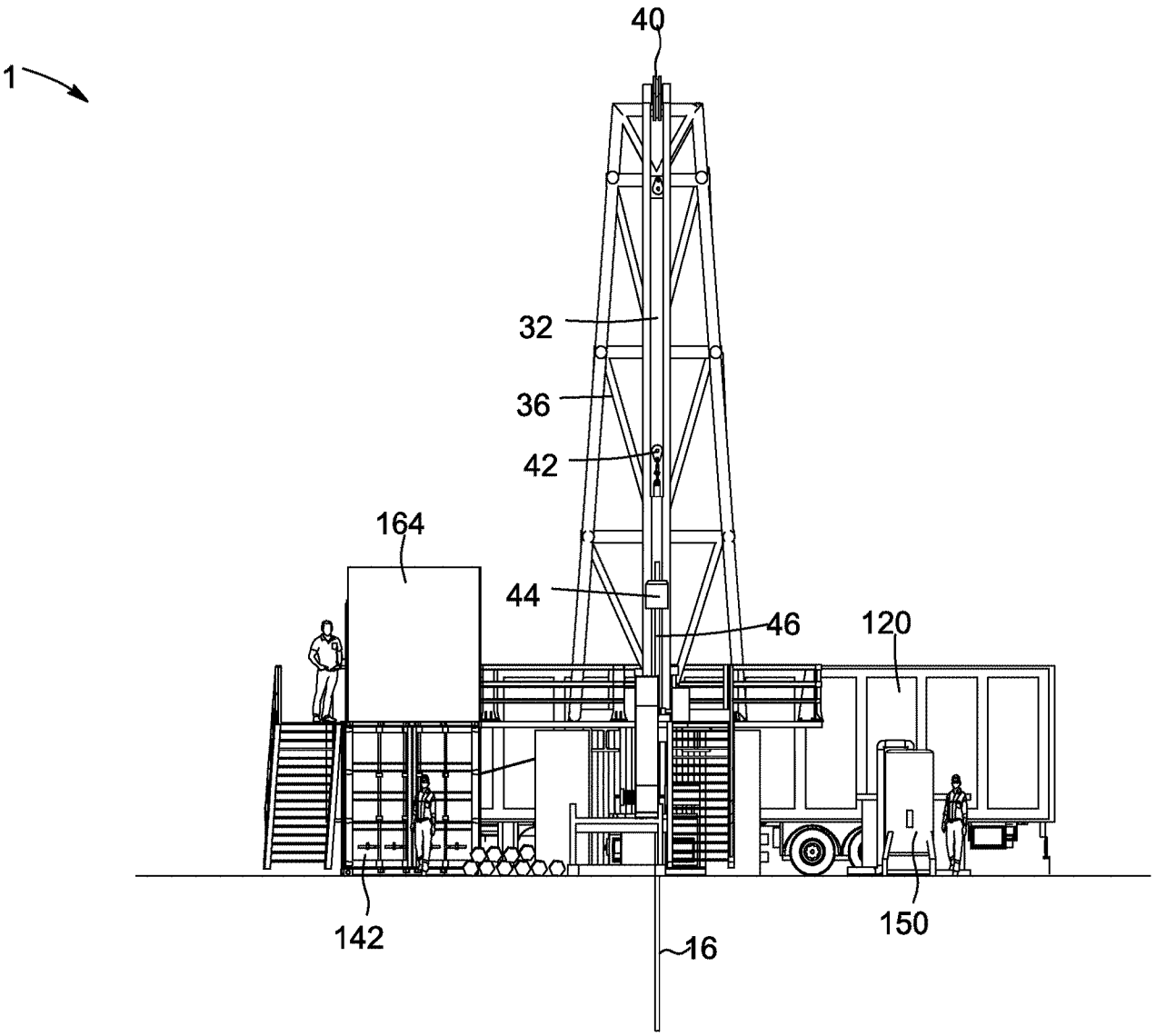
FIG. 6 illustrates an elevation view from a second side of the electrically-powered drilling rig according to the example embodiment.
Figure 7:
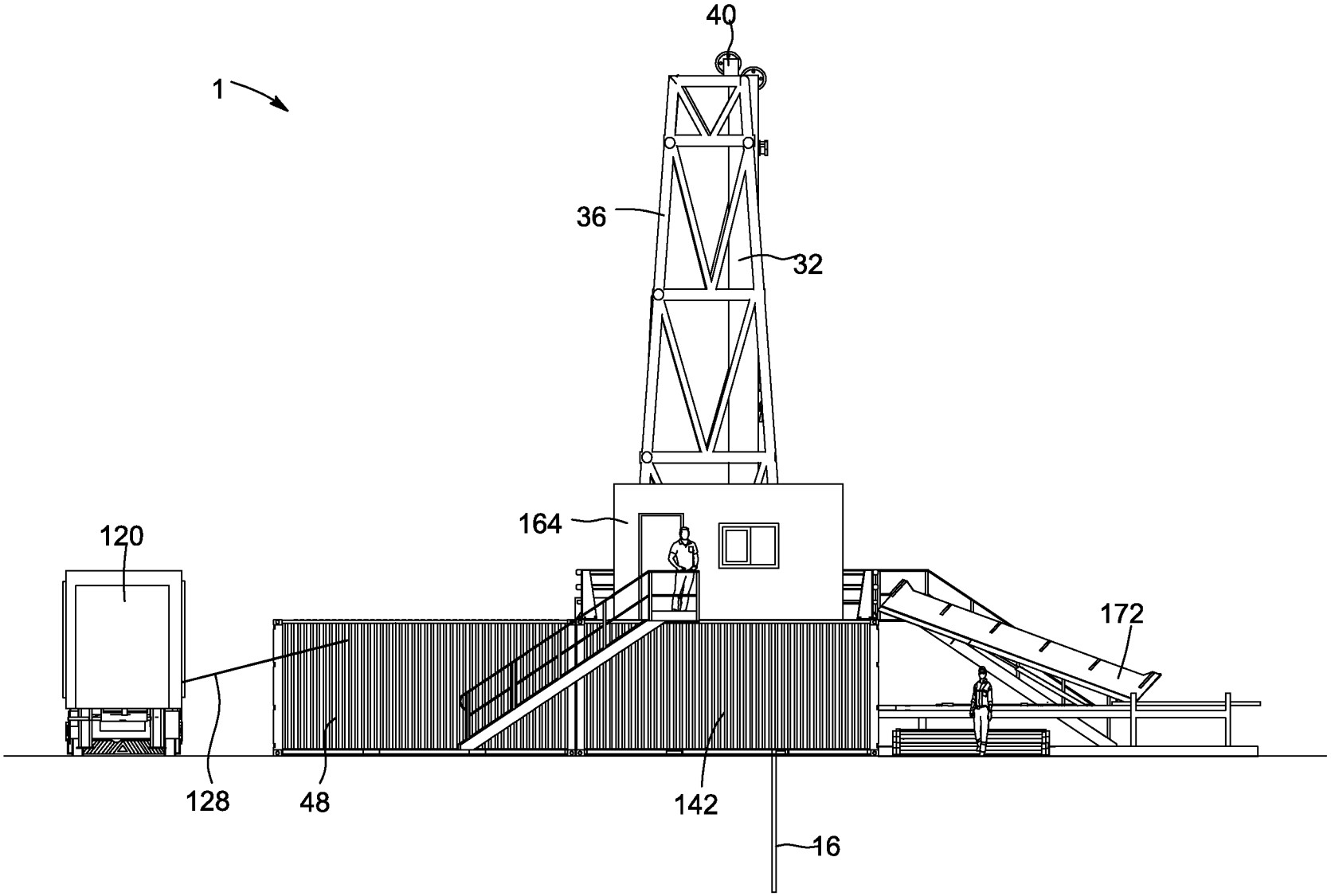
FIG. 7 illustrates an elevation view from a third side of the electrically-powered drilling rig according to the example embodiment.
Figure 8:
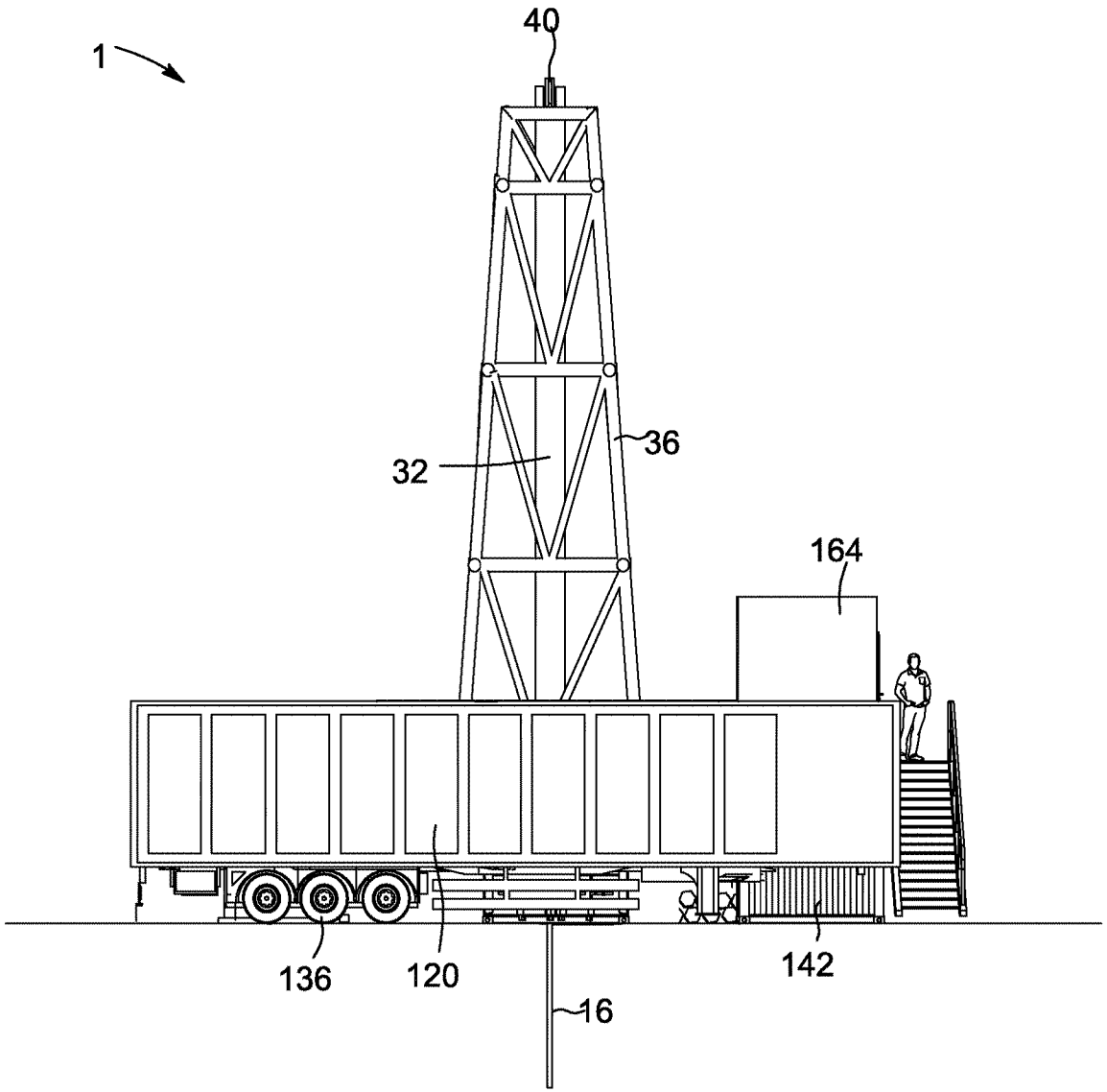
FIG. 8 illustrates an elevation view from a fourth side of the electrically-powered drilling rig according to the example embodiment.
Figure 9:
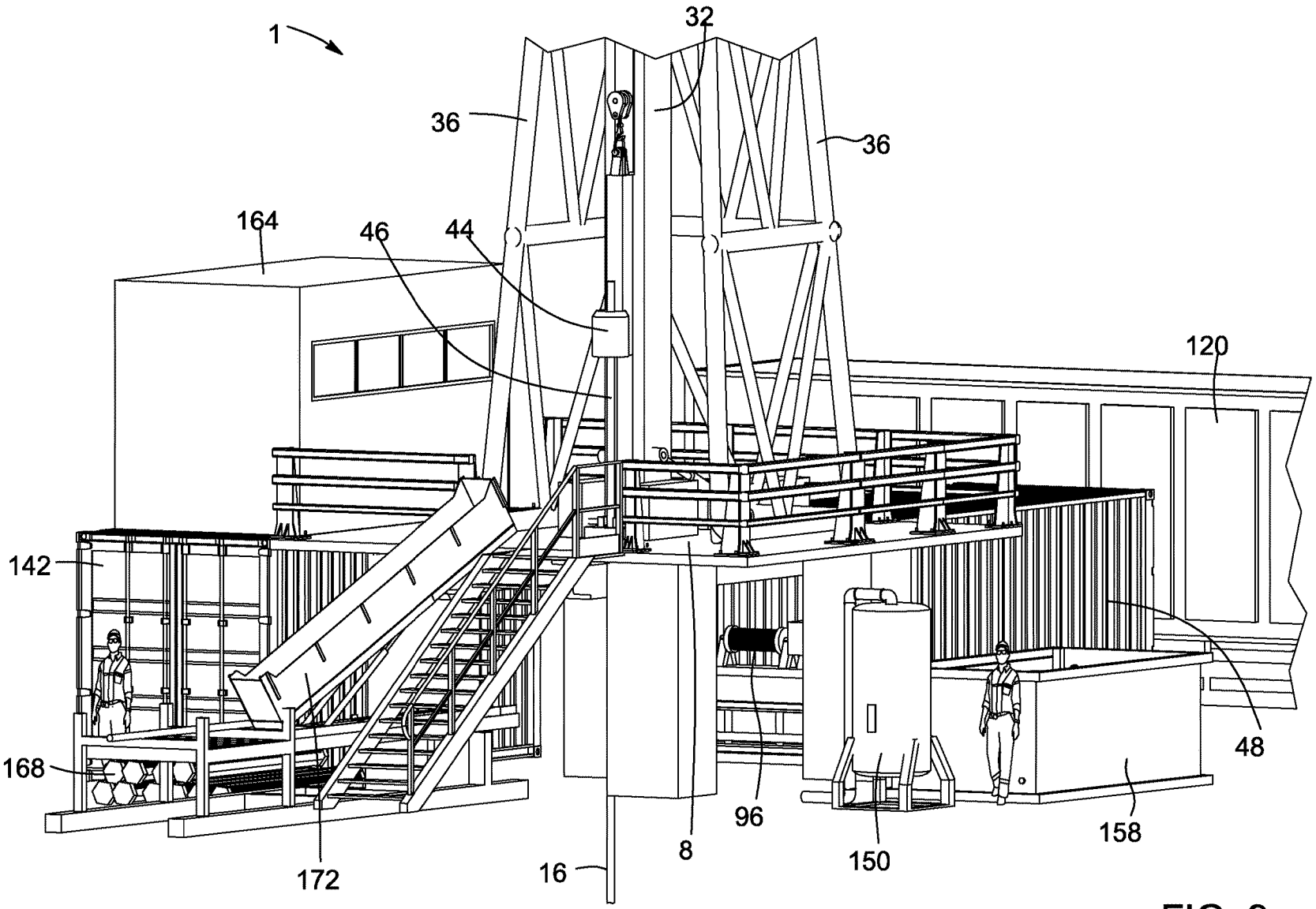
FIG. 9 illustrates a perspective view from the first direction of the electrically-powered drilling rig according to the example embodiment, showing components located underneath the drilling floor thereof.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

Referring now to FIGS. 1 to 4, therein illustrated are perspective views from four different directions of the electrically powered drilling rig 1 according to one example embodiment in a deployed state. FIGS. 5 to 8 illustrate elevation views from four different sides of the electrically powered drilling rig 1. The drilling rig 1, when deployed, includes a drilling floor 8 that is positioned over a well 16 being drilled. As commonly used in the prior art, the drilling floor 8 is a platform that is raised over the surface of the ground being drilled. A stairwell 24 is provided for workers to access the surface of the drilling floor 8 during a drilling operation.

The drilling rig 1 includes a set of pieces of drilling equipment that can be operated together to carry out the drilling operation, as further described herein.

The drilling rig 1 includes a drilling mast 32 and supporting tower 36 extending vertically upwardly from the drilling floor 8 and being substantially aligned with drilling well 16.

The drilling mast 32 supports various pieces of drilling equipment used for drilling the well 16, such as a crown block pulley 40, a portion of the drill line, a travelling block 42, a drill drive 44, a drill pipe 46 and a drill bit.

Figure 10:
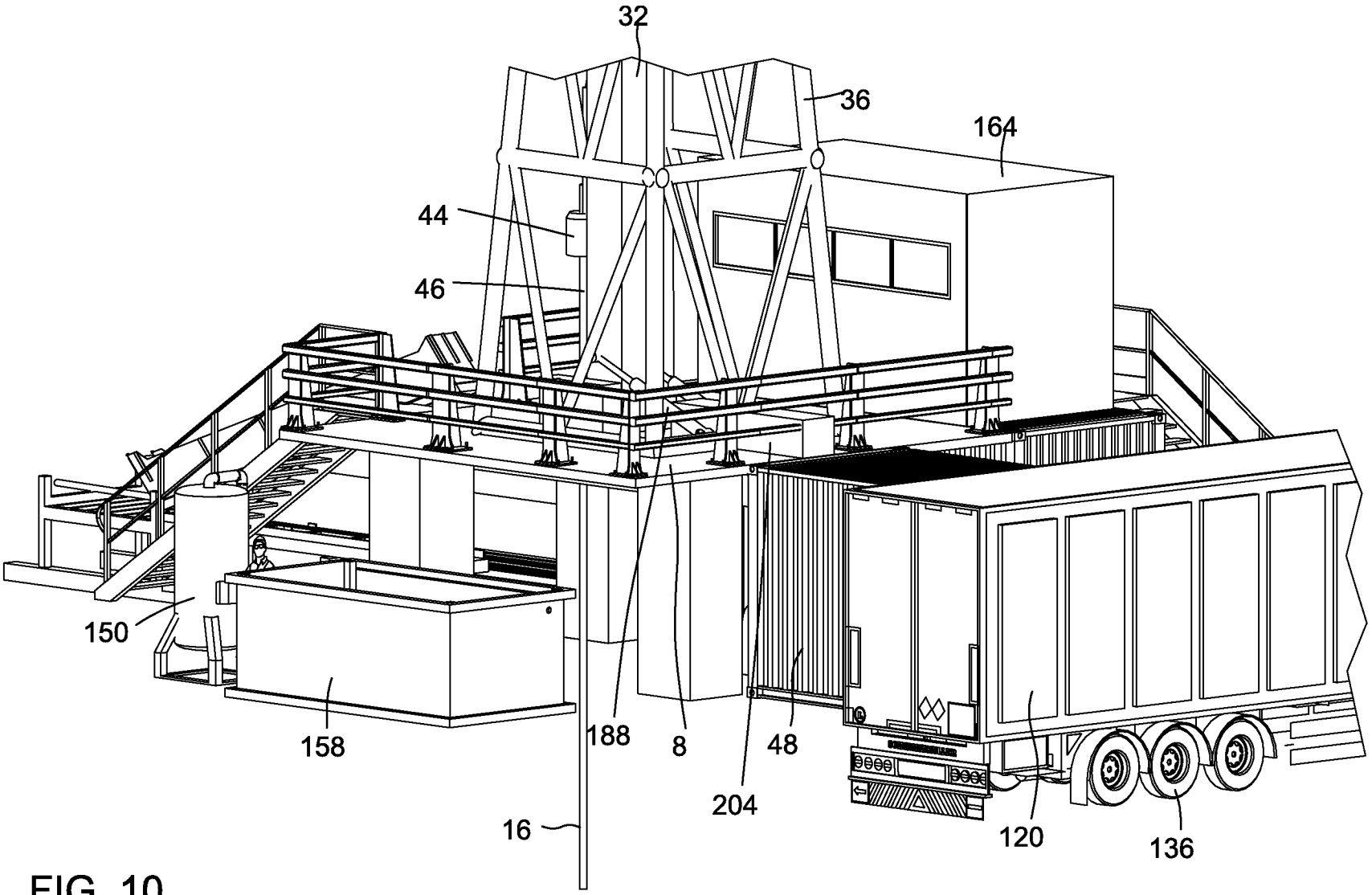
FIG. 10 illustrates a perspective view from the fourth direction of the electrically-powered drilling rig according to the example embodiment, showing components located underneath the drilling floor thereof.

A first enclosure 48 is positioned beside the drilling floor 8 when the drilling rig 1 is appropriately deployed. As illustrated, the first enclosure 48 is positioned in proximity of an edge of the drilling floor 8. However, the first enclosure 48 is located remotely of the drilling well 16 (as seen in FIG. 10). In the illustrated example, the footprint of the first enclosure 48 over the ground surface is non-overlapping with the footprint of the drilling floor 8. The first enclosure 48 may be disposed on the ground surface being drilled. For example, and as illustrated, the first enclosure 48 is a shipping container.

Figure 11:
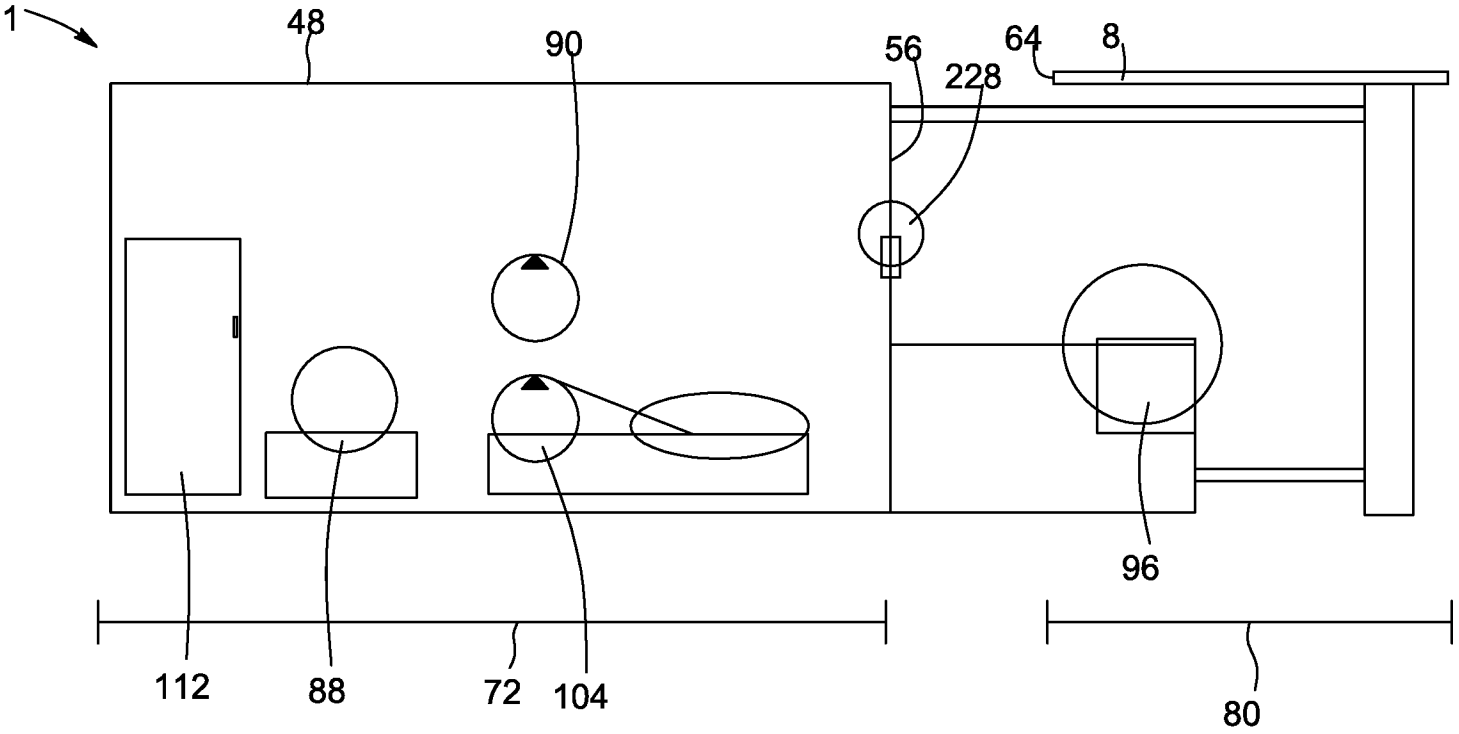
FIG. 11 illustrates a side elevation schematic view of a portion of the electrically-powered drilling rig according to an example embodiment.

Referring now to FIG. 11, therein illustrated is an elevated section view of a portion of the drilling rig 1 that includes the first enclosure 48. As illustrated, a drill-side wall 56 of the first enclosure 48 is positioned in proximity of a first edge 64 of the drilling floor 8. However, in the illustrated example, the footprint 72 occupied by the first enclosure 48 does not overlap with the footprint 80 of the drilling floor 1.

The first enclosure 48 houses various components of the drilling rig 1. As illustrated, at least one electric motor 88 is housed within the first enclosure 48. The electric motor 88 provides electric power to one or more of the set of pieces of drilling equipment. A battery management system operable for managing delivery of electricity from a battery pack to the electric motor 88 can also be housed within the first enclosure 48. Alternatively, the battery management system can be located outside of the first enclosure 48.

More particular, the electric motor 88 provides power to at least one hydraulic pump 90 that further provides hydraulic energy to one or more hydraulic-powered pieces of drilling equipment. The hydraulic pump 90 may also be housed within the first enclosure 48.

The at least one hydraulic pump 90 powered by the electric motor 88 can be used to power a draw-work winch 96 used for extending or retracting the drill line.

The at least one hydraulic pump 90 powered by the electric motor 88 can also be used to power the drill drive 44 for turning the drilling bit.

Continuing with FIG. 11, the first enclosure 48 may also house a mud pump 104. The at least one electric motor 88 can also power the mud pump 104 (via the hydraulic pump 90). The first enclosure 48 may further house at least one hydraulic accumulator 112. Hydraulic fluid used by the hydraulic pump 90, the mud pump 104 and/or other hydraulically powered pieces of drilling equipment may be stored within the hydraulic accumulator 112.

A hydraulic control system can also be housed within the first enclosure 48. This hydraulic control system may be used to select hydraulic equipment (ex: draw work winch 96, mud pump 104, etc.) that receives hydraulic fluid under pressure from the hydraulic pump 90 and/or hydraulic accumulator 112. The hydraulic control system can be a series of interconnected valves. In another embodiment, the hydraulic control system can include a plurality of quick snap connectors for selectively connecting various pieces of hydraulic equipment to the hydraulic accumulator 112.

The first enclosure 48 may also house a gearbox (not illustrated) for the draw work winch 96. A bath of lubricant oil into which the gearbox is dipped for maintaining lubrication of the gearbox can also be housed within the gearbox.

It will be understood that various components of the drilling rig 1 are powered by the at least one electric motor 88 in an indirect manner. More particularly, one or more pieces of drilling equipment are powered indirectly by the electric motor 88 via the hydraulic pump 90. The at least one electric motor 88 provides electric power to drive the hydraulic pump 90. The hydraulic pump 90 then provides pressurized fluid to drive the pieces of drilling equipment, such as the draw-work winch and the drill drive 44.

It was observed that the electric motor 88 may be susceptible to releasing sparks during operation. Such sparks can be a fire hazard if they occur near flammable or combustible substances such as natural gas or oil. According to various example embodiments described herein, housing the electric motor 88 within the first enclosure 48 provides an important safety measure where the drilling rig 1 is used in an operation for drilling for flammable or combustible substances, such as natural gas or oil. Furthermore, positioning the first enclosure 48 remotely of the drilling well also improves safety. By housing the electric motor 88 within the first enclosure 48, the enclosure 48 acts as a buffer between the electric motor 88 and the drilling well 16, whereby any sparks released by the electric motor 88 are prevented from being released outside of the enclosure 48 where they present a fire hazard. Locating the first enclosure 48 remotely of the drilling well 16 significantly reduces the likelihood that any sparks released by the electric motor 88 will reach the drilling well 16.

Housing the electric motor 88 and other pieces of equipment, such as the mud pump 104, hydraulic accumulator 112, hydraulic pump 90, hydraulic control system, etc., within the first enclosure 48 facilitates transportation of these pieces of equipment. For example, where the first enclosure 48 is a shipping container, these pieces of equipment can easily be transported by truck, train, or ships to various locations.

The electric-power drilling rig 1 further include at least one battery pack 120 for providing electricity to the electric motor 88. The battery pack 120 can be selectively connected to the electric motor 88. As illustrated, electric power lines 128 selectively connect the battery pack 120 to the electric motor 88 housed within the first enclosure 48. Multiple battery packs 120 may be connected together to provide power to the electric motor 88. Each battery pack 120 can be formed of a plurality of battery cells that are housed within a second enclosure. The second enclosure may be a second shipping container or may have the size and shape of a shipping container. As illustrated in FIG. 1, the battery pack 120 being housed within the second shipping container has been mounted onto a wheeled trailer 136 so that the battery pack 120 is mobile. Accordingly, when the electric charge in a first battery pack 120 has been drained, that battery pack 120 can be disconnected from the electric motor 88 and moved to a charging site. A second charged battery pack 120 can then be moved to near the electric motor 88 and connected thereto to continue powering the electric motor 88.

According to various example embodiments, the charging site can be located remotely of the drilling site. For example, the charging site may be connected to an electric grid and the depleted battery pack 120 is transported to the charging site and charged using power from the electric grid. It will be appreciated that charging the battery pack from the electric grid can reduce the overall environmental impact from operating the drilling rig 1, such as where the power on the electric grid is produced using renewable resources.

According to other example embodiments, the charging site may be located on or near the drilling site. Where a connection to an electric grid is not available, the battery pack may be charged using a generator. As described elsewhere herein, using a generator to recharge the battery pack can also reduce the environmental impact of operating the drilling rig 1 compared to using a fossil fuel motor to directly drive the various pieces of drilling equipment.

Continuing with FIG. 1, according to one example embodiment, the drilling rig 1 further includes a third enclosure 142, which may be a third shipping container, that houses one or more reservoirs for storing drilling fluid (commonly known as drilling mud). As is known in the art, the drilling fluid is effective for removing cuttings from the well 16, controlling pressure within the well 16 and cooling and lubricating the drill bit, as well as provide other functions useful in the drilling operation. As illustrated, the third enclosure 142 is located in proximity of the drilling floor 8 on a third side thereof. The drilling fluid is pumped into the drilling well during a drilling operation by the mud pump 104.

The drilling rig 1 further includes a vapor-liquid separator 150 that receives the liquid retrieved from the well 16 during the drilling operation. The vapor-liquid separator 150 is effective for separating gaseous substances within the retrieved material from the liquid substances. The liquid substances that is separated out is further received within a flow back tank 158. In the illustrated example, the vapor-liquid separator 150 and the flow back tank 158 is located in proximity of the drilling floor 8 on a second side thereof.

A control center 164 is also positioned in proximity of the drilling floor 8 and at a height that is level with or higher than the top surface of the drilling floor 8. The control center 164 houses the electronic controls for controlling various pieces of drilling equipment during a drilling operation. Operating personnel are positioned within the control center 164, oversee the drilling operation, issue required commands and control the pieces of drilling equipment during the drilling operation. In the illustrated example, the drilling floor 8 has a height that is approximately equal to a standard shipping container, and the control center 164 is positioned atop the third enclosure 142. A stairwell is provided to access the control center.

The example drilling rig 1 illustrated in the figures further includes a pipe rack 168 and a pipe ramp 172 positioned on a fourth side of the drilling floor 8. Drill pipe segments are stored on the pipe rack 168 and are carried via the pipe ramp 172 onto the drilling floor 8, whereby each segment is gradually connected onto a drill pipe already extending into the drilling well 16 while the drilling operation is ongoing.

Figure 12:
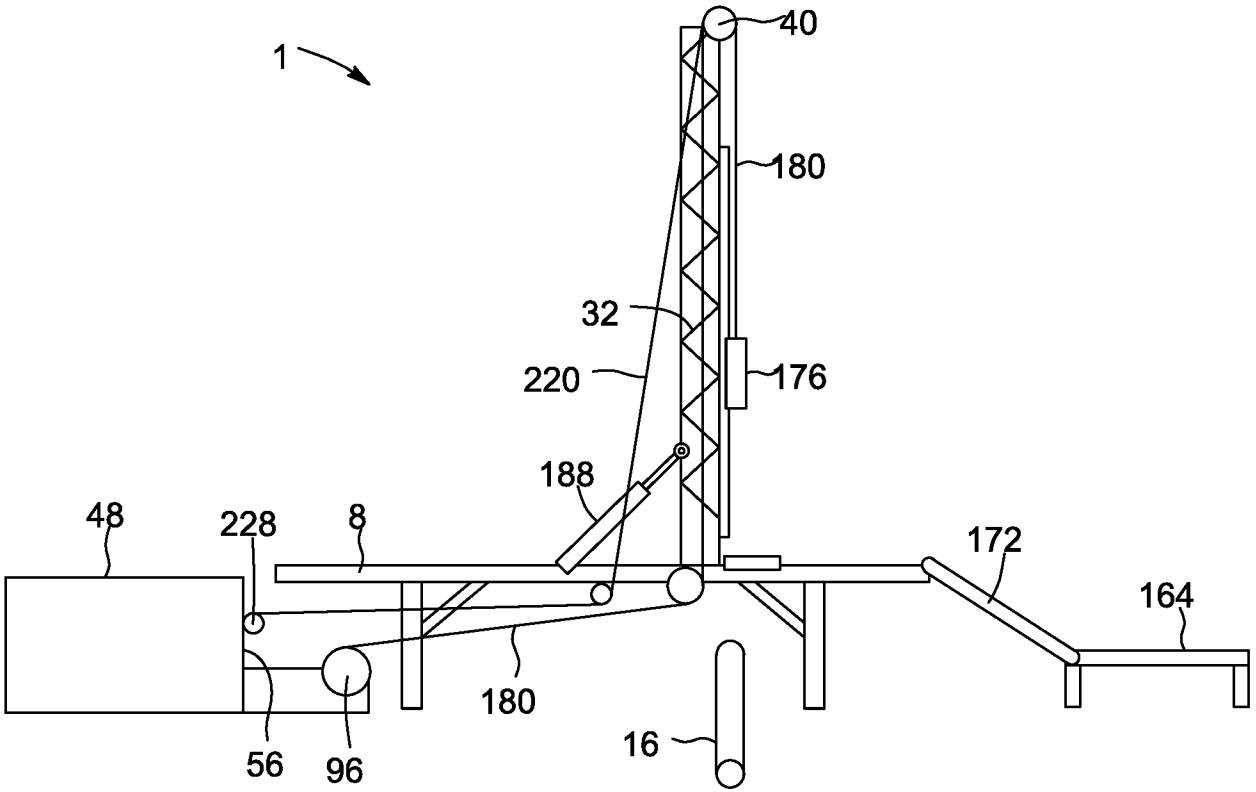
FIG. 12 illustrates a side elevation schematic view of the electrically-powered drilling rig according an example embodiment.

Referring now to FIG. 12, therein illustrated is a side elevation view of the drilling rig 1 being in a deployed state. As already described, the drilling floor 8 is positioned over the drilling well 16. More particularly, the drilling mast 32 is erected so that the drill bit 176 is aligned with the drilling well 16. The first enclosure 48 is positioned proximate the drilling floor 8 but remotely of the drilling well 16.

In the illustrated example, the draw-work winch 96 is positioned near the enclosure 48 to receive energy from the electrical motor 88 housed within the enclosure 48. A drill line 180 extends from the draw-work winch 96 to a base of the mast 32, up to the crown block pulley 40 and down to the drill bit 176.

In various example embodiments, the drilling mast 32 is collapsible. That is, the drilling mast 32 can be transported to the drilling site having already been assembled. The drilling mast 32 is then raised to its erect position for deployment. Erection of the drilling mast 32 can be carried out using at least one hydraulic actuator. The hydraulic actuator can be powered by the hydraulic pump 90 and/or hydraulic accumulator 112 housed in the enclosure 48.

In the example illustrated in the figures, hydraulic actuators 188 are provided to raise and lower the collapsible drilling mast 32. The hydraulic actuators 188 connect at their cylinder ends to a base member 204 that sits atop the drilling floor 1. Piston ends of the hydraulic actuator 188 are connected to the collapsible drilling mast 32. The base member 204 can further house hydraulic lines that receive hydraulic fluid from the hydraulic pump 90 and/or hydraulic accumulator 112.

In the example illustrated in FIGS. 11 and 12, a pair of parallel hydraulic actuators 188 are provided to raise and lower the collapsible drilling mast 32. However, a single actuator or more than two actuators may be used. An erection line 220 is also provided for raising and lowering the collapsible drilling mast 32. As illustrated, a secondary winch 228 controls the extending and retracting of the erection line 220. The erection line 220 extends from the secondary winch 228 to a top of the collapsible drilling mast 32. The secondary winch 228 can also be powered by the electric motor 88 housed within the enclosure 48. As further illustrated, the secondary winch 228 is attached to a front wall 56 of the enclosure 48, whereby the enclosure 48 acts as base for the winch 228 and erection line 220.

According to one example embodiment of the drilling rig 1 for slim hole drilling, an electric motor 88 rated at approximately 300 kW of power is selected. It will be appreciated that this power rating is on the same order of magnitude of a 250 HP diesel motor (186 kW). Furthermore, a battery pack 120 having a storage capacity of approximately 4 MWh is selected for supplying energy to the electric motor 88. This would provide the electric motor 88 with a continuous battery life of about 12 hours. For example, 16 batteries rated at 210 kWh (ex: PowerPack™ battery from Tesla™) would provide a storage capacity of 4.2 MWh. However, it will be understood that the electric motor 88 can have a different power rating. Similarly, battery packs offered by different manufacturers may be used.

Various example embodiments of the electrically-powered drilling rig 1 described herein provides a smaller footprint when deployed when compared to conventional drilling rigs.

The use an electric motor 88 to power the drilling rig 1 is particularly well adapted for slim hole drilling. The example embodiments described herein may use equipment developed for mining and coil drilling and adapt that equipment for oil and gas exploration. Such exploration can be safer and more efficient that currently available methods. When compared to a regular oil rig, the operations described herein can use a shorter drilling pipe, which results in a shorter drilling mast and smaller drilling floor. Furthermore, for slim hole drilling, less drilling fluid is used, which allows reducing capacity of the container holding the drilling fluid. By combining drilling pipes used for mining with a mud motor for coil drilling, it is possible to flexibly drill up to 3500 meters in depth.

Moreover, the footprint of the drilling rig 1 can be substantially reduced, for example, to about 900 $m^2$ (ex: 30 m by 30 m). The footprint of the drilling rig 1 corresponds to the area occupied by the drilling floor 8 and all other elements located around the drilling floors, such as the enclosure 48, the battery pack 120, the control center 164, the pipe rack 168, the pipe ramp 172, the liquid separator 150 and the flow back tank 158, etc. Furthermore, the use of the electric motor 88 can reduce the requirement for maintenance, which further reduces the amount of personnel required to operate the rig.

It was observed that the power demand on the motor from various pieces of drilling equipment can be highly variable during a drilling operation. For example, the power demand will vary according to which piece of equipment (ex: draw-work winch, drill drive, etc.) is currently being driven. It was further observed that the variable power demand can often cause a diesel motor or other fossil fuel motor to be operated outside of a peak efficiency range of the motor (ex: outside of an RPM range in which the motor provides power in the most efficient way). By contrast, the electric motor 88 used in various example embodiments described herein draws an amount of electric energy from a battery pack 120 that is substantially linearly proportional to the power demand. That is, the electric motor 88 does not have as clear a peak efficiency range as a diesel motor, or the like. Accordingly, use of the electric motor 88 can achieve higher overall energy efficiency in the drilling operation. Furthermore, as described elsewhere herein, the battery pack 120 can be charged using renewable energy, where available, which can further reduce environmental impact.

In various example embodiments where a generator (ex: a diesel generator) is used to recharge the battery pack 120 that is then used to power the electric motor 88, a higher efficiency in energy usage can be achieved compared to use of a diesel motor for directly powering the various pieces of drilling equipment. As described above, whereas the diesel motor would be operated outside of its peak efficiency range due to variability in power demand from drilling equipment, power consumption by the electric motor 88 is substantially linear to power demand. Furthermore, when being operated to charge a battery pack, the generator can be continuously operated within its peak efficiency range. It will be appreciated that the combination of the electric motor 88 and the generator avoids the energy waste caused from the periods of otherwise operating a fossil fuel motor outside its peak efficiency range.

According to a method for operating a drilling rig 1, components of the drilling rig 1 are transported to the drilling site in their disassembled form. As described elsewhere herein, housing various components in various enclosures, such as shipping containers 48, 120 and 142 facilitates their transportation to the drilling site.

Upon arrival at the drilling site, the drilling rig 1 is assembled. Assembly includes assembling the drilling floor 8 and placing various containers enclosing the drilling equipment at their appropriate locations, as described elsewhere herein.

It will be appreciated that various components are ready to use when enclosed in the shipping container, such as the electric motor 88 and hydraulic pump 90 being ready to use from the first container 48, the battery pack 120 being usable while mounted on the wheeled trailer 136 and the drilling fluid being ready to use while enclosed in the third container 142. This further facilitates installation upon arrival to the drilling site.

The battery pack 120 is then connected to the at least one electric motor 88 so that power can be supplied to various pieces of drilling equipment. Initially, the electric motor 88 can be operated to power the hydraulic pump 90 so as to further charge the accumulator 112. Accordingly, power from the electric motor 88 (via the hydraulic pump 90 and accumulator 112) can be used to complete the assembly of the drilling rig. This includes operating the hydraulic actuator 188 and/or the secondary winch 228 to erect the collapsible drilling mast 32

Upon completing assembly of the drilling rig 1, the rig 1 can be operated to drill the drilling well. Drilling the well includes operating the electric motor 88 to provide energy to the set of pieces of drilling equipment. This may include powering the hydraulic pump 90, using the pressurized fluid to power the drill drive 44 and cause rotation of the drill bit, controlling the height of the drill drive 44 and drill bit 176 via the draw-work winch 96, and operating the mud pump 104.

The drilling operation is continued until the battery pack 120 providing electrical energy is depleted. Upon the battery pack 120 being depleted, the depleted battery pack 120 is disconnected from the electric motor 88 and brought to a charging site for recharging. As described elsewhere herein, the battery pack 120 can be charged from an electric grid or using a generator. Another fully charged battery pack 120 is immediately transported to the drilling site and connected to the at least one electric motor 88 so that drilling operation can be continued. As described herein, the storage capacity of the battery pack 120 is selected in accordance with the rating of the electric motor 88 so as to permit operation for a cycle of approximately 12 hours in duration. This 12 hour-cycle corresponds to the typical length of a work shift in the oil and gas exploration industry.

The drilling operation can be continued until a desired depth of the drilling well 16 is reached.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. An electrically powered drilling rig comprising:
a drilling floor positioned over a drilling well;
a set of pieces of drilling equipment operable for drilling the well;
a first enclosure being positioned remotely of the drilling well;
at least one electric motor being housed within the first enclosure, the electric motor
providing power to one or more of the set of pieces of drilling equipment; and
at least one mobile battery pack selectively connectable to the electric motor to
supply electric energy thereto, the mobile battery pack being housed within a
second enclosure.

2. The drilling rig of claim 1, wherein the first enclosure is positioned in proximity of the drilling floor.

3. The drilling rig of claim 2, wherein a footprint of the first enclosure is non-overlapping with a footprint of the drilling floor.

4. The drilling rig of claim 1, wherein the first enclosure provides a buffer between the at least one electric motor and the drilling well, whereby the first enclosure prevents sparks from the electric motor from reaching the drilling well.

5. The drilling rig of claim 4, wherein the first enclosure is a first shipping container.

6. The drilling rig of claim 1, further comprising at least one hydraulic pump being powered by the electric motor and configured to provide hydraulic energy to the set of pieces of drilling equipment, the hydraulic pump also being housed within the first enclosure.

7. The drilling rig of claim 6, wherein the set of pieces of drilling equipment powered by the hydraulic pump comprises:
drilling pipes used for mining;
a mud motor for coil drilling;
a mud pump for pumping drilling fluid into the drilling well, the mud pump being powered by the electric motor and being housed within the first enclosure; and
a hydraulic accumulator for the mud pump, the hydraulic accumulator being housed within the first enclosure.

8. The drilling rig of claim 1, wherein a storage capacity of the battery pack provides approximately 12 hours of battery life for supplying electric energy to the at least one electric motor; and
wherein the second enclosure is mountable onto a wheeled trailer.

9. The drilling rig of claim 1, further comprising a third enclosure for storing drilling fluid, wherein the third enclosure is a third shipping container.

10. The drilling rig of claim 1, wherein the set of pieces of drilling equipment receiving power from the electric motor comprises one or more of a hydraulic pump, a draw-work winch, drill drive, and hydraulic actuator, and a secondary winch for erecting a collapsible drilling mast.

11. An electrically powered drilling rig comprising:
a drilling floor positioned over a drilling well;
a set of pieces of drilling equipment operable for drilling the well;
at least one electric motor being housed within a first enclosure, the electric motor
providing power to one or more of the set of pieces of drilling equipment, and the
first enclosure providing a buffer between the at least one electric motor and the
drilling well, whereby the first enclosure prevents sparks from the electric motor
from reaching the drilling well; and
at least one mobile battery pack selectively connectable to the electric motor to
supply electric energy thereto, the mobile battery pack being housed within a
second enclosure.

12. The drilling rig of claim 11, wherein the first enclosure is positioned in proximity of the drilling floor.

13. The drilling rig of claim 12, wherein a footprint of the first enclosure is non-overlapping with a footprint of the drilling floor.

14. The drilling rig of claim 13, wherein the first enclosure is a first shipping container.

15. The drilling rig of claim 11, further comprising at least one hydraulic pump being powered by the electric motor and configured to provide hydraulic energy to the set of pieces of drilling equipment, the hydraulic pump also being housed within the first enclosure.

16. The drilling rig of claim 15, wherein the set of pieces of drilling equipment powered by the hydraulic pump comprises:

drilling pipes used for mining;

a mud motor for coil drilling;

a mud pump for pumping drilling fluid into the drilling well, the mud pump being powered by the electric motor and being housed within the first enclosure;

a hydraulic accumulator for the mud pump, the hydraulic accumulator being housed within the first enclosure.

17. The drilling rig of claim 11, wherein a storage capacity of the battery pack provides approximately 12 hours of battery life for supplying electric energy to the at least one electric motor; and wherein the second enclosure is mountable onto a wheeled trailer.

18. The drilling rig of claim 11, further comprising a third enclosure for storing drilling fluid, wherein the third enclosure is a third shipping container.

19. The drilling rig of claim 11, wherein the set of pieces of drilling equipment receiving power from the electric motor comprises one or more of a hydraulic pump, a draw-work winch, drill drive, hydraulic actuator, and a secondary winch for erecting a collapsible drilling mast.

20. An electrically powered drilling rig comprising:

a drilling floor positioned over a drilling well;

a set of pieces of drilling equipment operable for drilling the well, the set including a drill drive;

at least one electric motor;

at least one mobile battery pack selectively connectable to the electric motor to supply electric energy thereto; and a hydraulic pump powered by the electric motor, the hydraulic pump being configured to provide hydraulic energy to the set of pieces of drilling equipment, the hydraulic pump together with the electric motor being enclosed providing a buffer between the hydraulic pump together with the electrical motor and the drilling well, thereby preventing sparks from electric motor from reaching the drilling well.

21. The drilling rig of claim 20, wherein the set of pieces of drilling equipment receiving power from the electric motor comprises one or more of a draw-work winch, drill drive, hydraulic actuator, and a secondary winch for erecting a collapsible drilling mast.

22. The drilling rig of claim 21, wherein the set of pieces of drilling equipment powered by the hydraulic pump comprises:

drilling pipes used for mining and a mud motor for coil drilling;

a mud pump for pumping drilling fluid into the drilling well; and a hydraulic accumulator for the mud pump.

23. The drilling rig of claim 20, wherein a storage capacity of the battery pack provides approximately 12 hours of battery life for supplying electric energy to the at least one electric motor, wherein the mobile battery pack is mountable onto a wheeled trailer.

24. A method for operating an electrically powered drilling rig, the method comprising:

positioning a drilling floor over a drilling well;

providing power from at least one electric motor being supplied by a mobile battery pack to a set of pieces of drilling equipment operable for drilling the well, the at least one electric motor being housed within a first enclosure positioned remotely of the drilling well, the first enclosure being a first shipping container; and operating a set of pieces of drilling equipment to drill the well.

25. The method of claim 24, wherein the first enclosure is positioned in proximity of the drilling floor.

26. The method of claim 25, wherein a footprint of the first enclosure is non-overlapping with a footprint of the drilling floor.

27. The method of claim 24, wherein the first enclosure provides a buffer between the at least one electric motor and the drilling well, whereby the first enclosure prevents sparks from the electric motor from reaching the drilling well.

28. The method of claim 24, wherein providing power from the at least one electric motor to the set of pieces of drilling equipment comprises:

powering a hydraulic pump using electric energy from the electric motor, the hydraulic pump being housed within the first enclosure; and providing pressurized fluid from the hydraulic pump to power the set of pieces of drilling equipment.

29. The method of claim 28, wherein the set of pieces of drilling equipment comprises a mud pump for pumping drilling fluid into the drilling well, the mud pump being powered by the electric motor and being housed within the first enclosure.

30. The method of claim 29, wherein the drilling fluid is stored in an enclosure other than the first enclosure.

31. The method of claim 24, wherein a storage capacity of the battery pack provides approximately 12 hours of battery life for supplying electric energy to the at least one electric motor; and wherein the mobile battery pack is replaceable.

32. The method of claim 24, wherein the set of pieces of drilling equipment receiving power from the electric motor comprises one or more of a draw-work winch, drill drive, hydraulic actuator, and a secondary winch for erecting a collapsible drilling mast.

* * * * *